United States Patent [19]

Petko

[11] Patent Number: 4,846,749

[45] Date of Patent: Jul. 11, 1989

[54] AERODYNAMIC FLYING TOY

[76] Inventor: Charles J. Petko, 25 Arnold St., Buffalo, N.Y. 14213

[21] Appl. No.: 227,130

[22] Filed: Aug. 2, 1988

[51] Int. Cl.[4] ..... A63H 27/00; A63B 65/10

[52] U.S. Cl. ..... 446/36; 446/46; 446/47

[58] Field of Search ..... 446/46–48, 446/36–42, 217, 218; 273/424, 425

[56] References Cited

U.S. PATENT DOCUMENTS

| | | | |
|---|---|---|---|
| D. 155,437 | 10/1949 | Molin et al. | 446/218 X |
| 4,077,155 | 3/1978 | Bruntmyer | 446/46 |
| 4,112,613 | 9/1978 | Toplak | 446/42 |
| 4,115,946 | 9/1978 | Vukmirovich | 446/46 X |
| 4,134,229 | 1/1979 | Lehman | 446/47 |
| 4,184,284 | 1/1980 | Rogahn | 446/48 X |
| 4,209,936 | 7/1980 | Sklar | 446/46 |
| 4,246,720 | 1/1981 | Stone | 446/47 |
| 4,301,616 | 11/1981 | Gudgel | 446/47 |
| 4,607,850 | 8/1986 | O'Riley | 273/424 |

*Primary Examiner*—Mickey Yu

*Attorney, Agent, or Firm*—Jerry T. Kearns

[57] ABSTRACT

A new saucer-shaped aerodynamic throwing toy is disclosed. The flight body is provided with a shaft on which a propeller is mounted, resulting in an unusual "hopping" effect during use without decreasing the overall flight time. The shaft is removable, thereby allowing the toy to be converted into an implement with more conventional characteristics. The pitch of the propeller blades is adjustable, and the body may be provided with small battery powered lights to enable the toy to be used at night.

11 Claims, 4 Drawing Sheets

AERODYNAMIC FLYING TOY

BACKGROUND OF THE INVENTION

1. Field of the Invention

The field of the present invention is recreational devices, and more particularly aerodynamic saucer-shaped implements for throwing. The present invention differs from other such devices in that it comes equipped with a propeller assembly mounted on a shaft. This imparts to the toy an unusual "hopping" behavior which adds interest to the use of the toy.

2. Description of the Prior Art

The prior art is replete with various types of saucer-shaped throwing implements, some of which have achieved great popularity over the last 20 years and so. It has thus become common to see groups of diverse ages enjoying themselves with these toys at parks and beaches, not to mention backyards and streets, all over the country. Indeed, a high level of skill in utilizing these toys has become not at all unusual, with many achieving a skill level bordering on the virtuosic.

However, many find these toys a bit difficult to use at a first try, and therefore a number of inventions have been directed towards making them easier to deal with. A good example is to be found in U.S. Pat. No. 4,216,611 issued to Louis G. Psyras on Aug. 12, 1980. This patent discloses a saucer-shaped disc of the conventional sort which is provided with a number of air spoilers on its upper, or convex, surface. These spoilers may take the form either of radially extending grooves inscribed in the surface, or they may consist of raised portions of various shapes. The object of the spoilers is to decrease aerodynamic drag, thereby providing greater stability and a longer flight time.

Another approach towards making a saucer-shaped throwing toy which is easier to use is disclosed in U.S. Pat. No. 4,516,949, which issued to Michael R. Rodarte on May 14, 1985. Here the conventional saucer-shaped main body is provided with a centrally located flared disc which is bearing mounted on the concave side of the toy and which rotates freely with respect to the main body. This disc is intended to make it a simple matter to catch the thrown toy without having it lose its rotational momentum.

Inasmuch as the art is relatively crowded with respect to these various types of aerodynamic throwing toys, it can be appreciated that there is a continuing need for and interest in improvements to such toys, and in this respect the present invention addresses this need and interest. Furthermore, it will be noted that these prior art toys are for the most part directed towards making the use of these toys a simpler task for the novice. In this respect, the present invention offers a new alternative by providing a toy which adds interest to the use of such toys by virtue of a less predictable flight pattern. Although the total flight time of the toy is indistinguishable from that of a similar toy without the propeller, the toy tends to "hop" in a way that is quite unpredictable. This hopping effect, presumably resulting from a heightened ability to catch small updrafts and downdrafts, adds interest to the game when used by a skilled player.

SUMMARY OF THE INVENTION

In view of the foregoing disadvantages inherent in the known types of aerodynamic throwing toys now present in the prior art, the present invention provides an improved aerodynamic throwing toy. As such the general purpose of the present invention, which will be described subsequently in a greater detail, is to provide a new and improved aerodynamic throwing toy which has many of the advantages of the prior art aerodynamic throwing toy constructions and none of the disadvantages.

To attain this, representative embodiments of the concepts of the present invention are illustrated in the drawings and make use of a generally saucer shaped flight body with a circumferential downwardly extending rim. A shaft arises upwardly from the center of the upper surface of the flight body and a propeller assembly is attached thereto. In a second embodiment of the invention the pitch of the propeller blades is adjustable, and the shaft with accompanying propeller assembly may be removed and reattached to the flight body. In this second embodiment of the invention, lights may be provided in the flight body to facilitate use of the toy at night.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining two embodiments of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved aerodynamic throwing toy which avoids the disadvantages of the prior art while retaining many of the advantages.

It is another object of the present invention to provide a new and improved aerodynamic throwing toy which may be easily and efficiently manufactured and marketed.

It is a further object of the present invention to provide a new and improved aerodynamic throwing toy which is of a durable and reliable construction.

An even further object of the present invention is to provide a new and improved aerodynamic throwing toy which is susceptible of a low cost of manufacture with regard to both materials and labor, and which accordingly, then susceptible of low prices of sale to the consuming public, thereby making such toys economically available to the buying public.

Still yet another object of the present invention is to provide a new and improved aerodynamic throwing toy providing a propeller assembly mounted on a shaft arising from the flight body of the toy.

Yet another object of the present invention is to provide a new and improved aerodynamic throwing toy wherein the aforementioned shaft and propeller assembly is removable.

Yet another object of the present invention is to provide a new and improved aerodynamic throwing toy wherein the pitch of the blades of the aforementioned propeller assembly may be easily varied.

Still another object of the present invention is to provide a new and improved aerodynamic throwing toy which utilizes battery powered lights set into various locations on the flight body, thereby rendering the toy useful for night use.

These together with other objects of the invention, along with the various features of novelty which characterize the invention, are pointed out with particularly in the claims annexed to and forming a part of this disclosure. For a better understanding of the invention, its operating advantages and the specific objects attained by its uses, reference should be had to the accompanying drawings and descriptive matter in which there is illustrated two preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
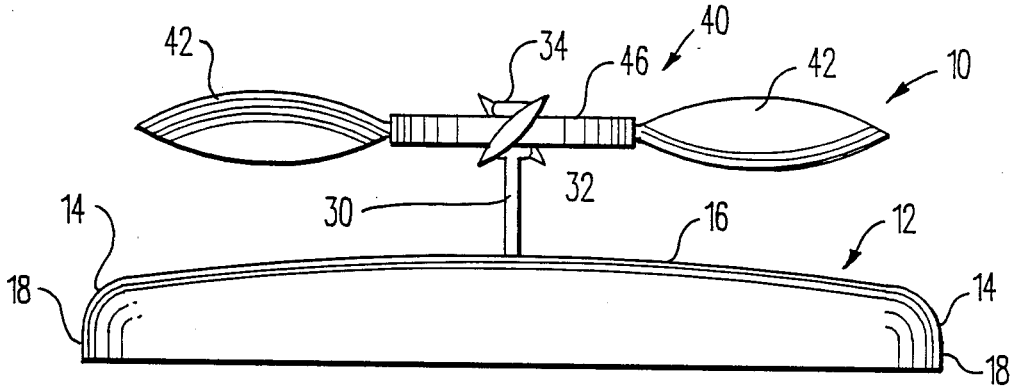
FIG. 1 is a side elevational view of an aerodynamic throwing toy according to the first embodiment of the present invention.
Figure 2:
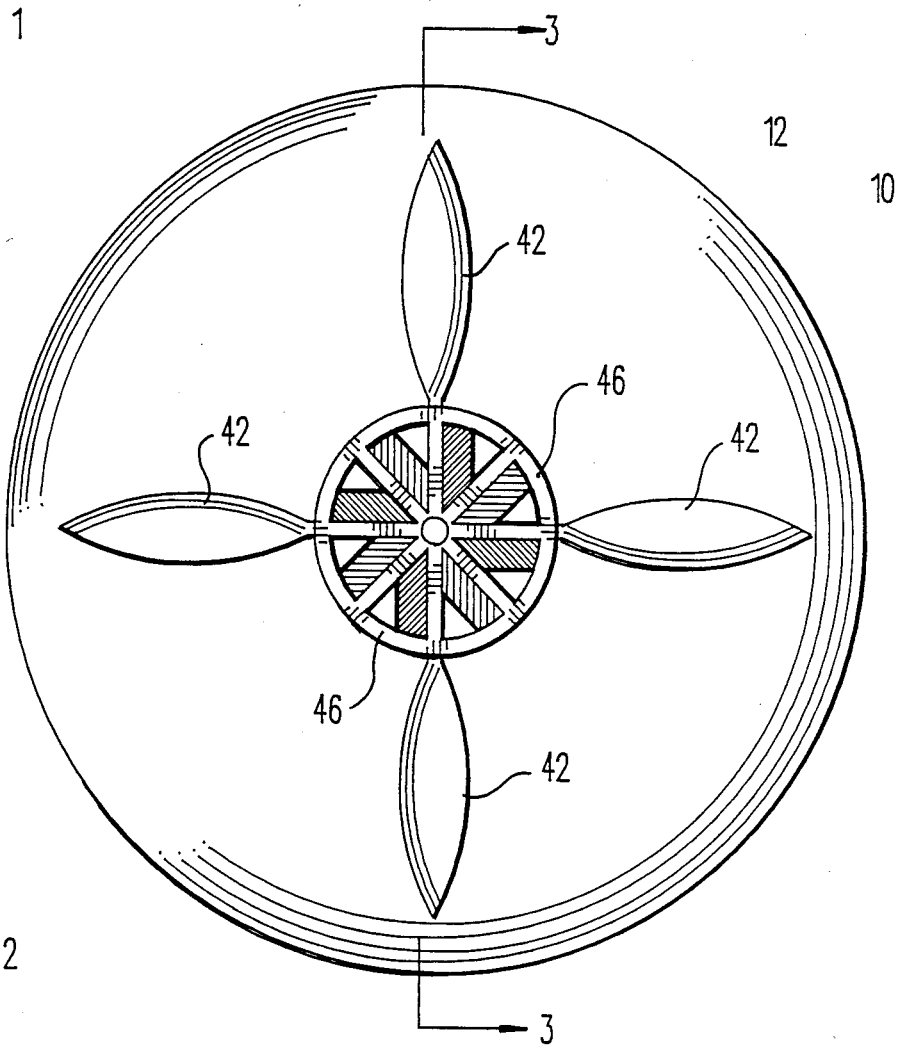
FIG. 2 is a top plan view thereof.
Figure 3:
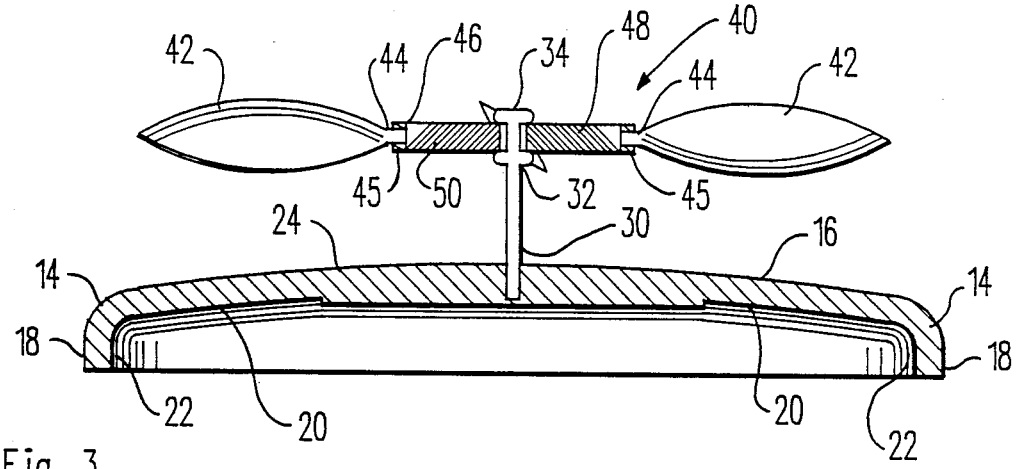
FIG. 3 is a cross sectional view taken along line 3—3 of FIG. 2.

With reference now to the drawings, and in particular to FIGS. 1, 2, and 2 thereof, a new and improved aerodynamic throwing toy embodying the principles and concepts of the present invention and generally designated by the reference numeral 10 will be described.

More specifically, it will be noted that the first embodiment 10 of the invention includes a generally saucer-shaped flight body 12 having a downwardly extending rim portion 14 integral therewith. The flight body 12 has a convex upper surface 16 which is contiguous with the outer surface 18 of the rim portion. The concave inner surface 20 of the flight body is likewise contiguous with the inner surface 22 of the rim portion.

A shaft 30 arises upwardly from the center of the upper surface of the flight body 16. There is a thickening 24 at the center of the flight body to give support to the shaft, which may be either integral with the flight body or glued onto it.

The propeller assembly 40 is mounted between two flanges 32, 34 located on the shaft. The propeller assembly 40 includes a plurality of propeller blades 42 which terminate at their central ends in small cylindrical necks 44. These necks 44 are fixedly secured in horizontal apertures 45 found in a circular inner rim portion 46. Extending inwardly from the rim portion 46 is a plurality of vanes 48 which have a flat rectilinear shape. The flat surfaces of these vanes are disposed at approximately 45°. Each vane is fixedly secured to a central hub 50, and it is the hub which is adjacent the shaft 30. Flight testing shows that the hopping effect of the toy is achieved equally well when the hub is either rotatably or fixedly secured to the shaft. In the situation where the hub is fixedly secured to the shaft, the flanges are not necessary.

Figure 4:
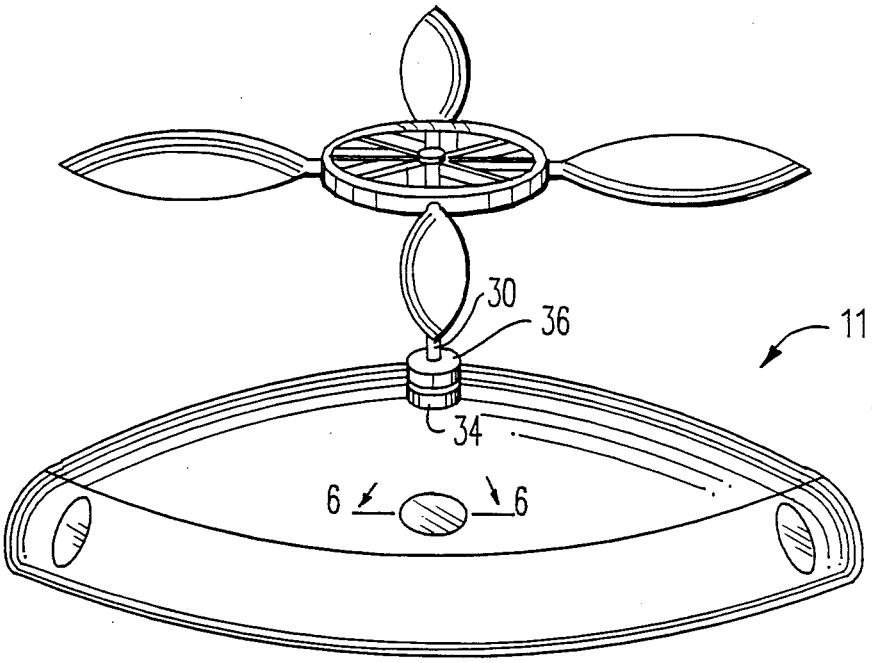
FIG. 4 is a perspective view according to a second embodiment of the present invention.

FIG. 4 shows a perspective view of a second embodiment 20 of the invention in which the shaft 30 is removable. As can be seen in the cross sectional view shown in FIG. 5 there are threads 38 on the end of the shaft 30 which engage the threads of nut 34 which is embedded in the center of the upper surface 16 of the flight body. A knurled nut 36 makes the attachment of the shaft secure. The nut 34 may be integral with the rest of the flight body.

Figure 8:
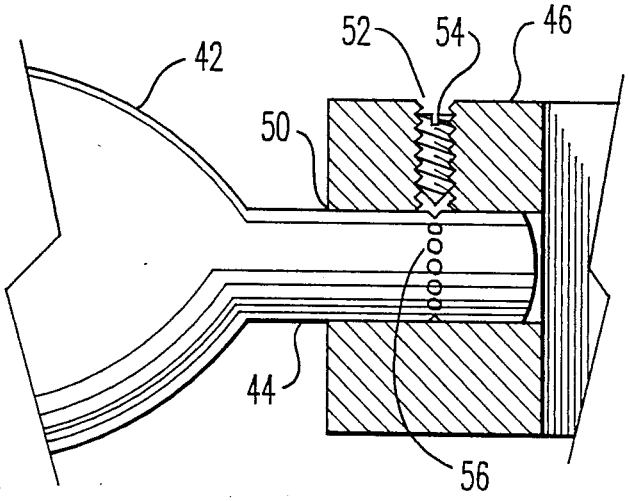
FIG. 8 is an enlarged cross-sectional view of the attachment of the propeller blade to the circular rim of the propeller assembly of the second embodiment.

The second embodiment of the invention also includes a means to adjust the pitch of the propeller blades 42. As best shown in the enlarged detail view of FIG. 8 the neck 44 of the propeller blade 42 fits into the horizontal aperture 50 of the rim 46. A small set screw 54 fits into the vertical aperture 52 of the rim 46. The point of the set screw can engage any of a number of small indentations 56 set circumferentially about the neck of the propeller blade.

Figure 5:
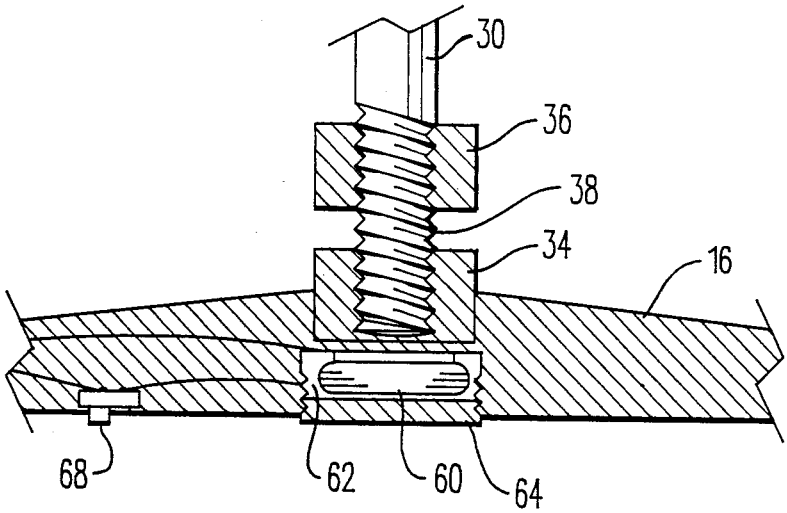
FIG. 5 is an enlarged cross-sectional view of the center of the flight body of the second embodiment showing the details of the attachment of the shaft to the flight body as well as the relationships among the battery, switch, and shaft.
Figure 6:
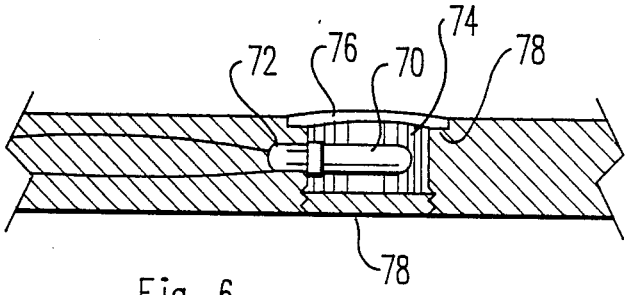
FIG. 6 is an enlarged cross-sectional view taken across line 6—6 of FIG. 4.
Figure 7:
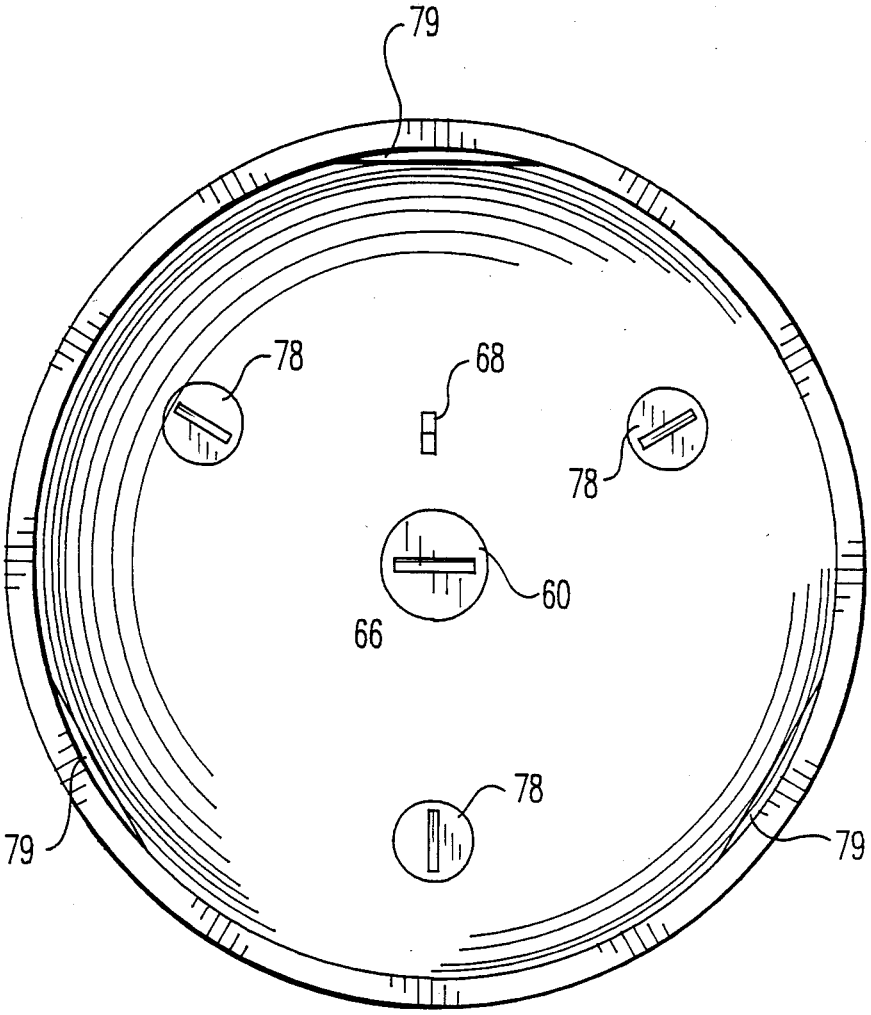
FIG. 7 is a bottom plan view of the second embodiment of the present invention.

The second embodiment of the invention also includes a system of small lights to create a pleasing visual effect and to allow the toy to be used at night. As seen in FIG. 5 a small disc shaped battery 60 is housed in a cavity 62 located in the center of the inner surface of the flight body. The battery is retained in the cavity by a threaded slotted plug 64, shown also in FIG. 7. The slot 66 allows removal of the plug 60 by means of a coin. The battery is electrically connected to each of several small light bulbs mounted at various places in the flight body. As best shown in FIG. 6 each light bulb 70 fits into a socket 72 which is found in an aperture 74 of the flight body. The aperture is covered on the outer surface by a thin transparent lens 76 which is glued onto a small rim 78 of the aperture 74. The inside opening of the aperture 74 is covered by a threaded slotted plug 78. FIG. 7 also shows thickenings 79 in the rim of the flight body to allow lights to be set therein. A flat switch 68 allows the circuit to be opened or closed. The aerodynamic flight toys 10 and 11 of the first and second embodiments are preferably formed from a plastic material, although it is possible in principle to utilize any rugged lightweight material.

With respect to the above description then, it is to be realized that the optimum dimensional relationships for the parts of the invention, to include variations ins size, materials, shape, form, function and manner of operation, assembly and use, ar deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An aerodynamic toy, comprising:

a. a flight body, said flight body being substantially saucer-shaped, said flight body including an upper convex surface and a lower concave surface, said flight body further including a circumferential rim contiguous with and extending downwardly from said upper and lower surfaces, said rim having an outer surface contiguous with said convex surface of said flight body, said rim having further an inner surface contiguous with said concave surface of said flight body;

b. a shaft, said shaft extending upwardly from the center of said flight body, said shaft having proximal and distal ends, said proximal end of said shaft being fixedly secured to said flight body, said shaft having further first and second flanges, said first flange being positioned at said distal end of said shaft, said second flange being positioned between said first flange and said proximal end of said shaft;

c. a propeller assembly rotatably mounted on said shaft, said propeller assembly comprising a plurality of propeller blades, said propeller assembly further including a central wheel, said central wheel comprising:

i. a hub rotatably mounted on said shaft;

ii. a plurality of vanes fixedly secured to said hub and extending radially therefrom; and, iii. a circular rim fixedly secured to said vanes, said propeller blades being attached to said circular rim;

d. a shaft removal and attachment means whereby said shaft and attached propeller assembly may be easily removed from and reattached to said flight body, said shaft removal and attachment means including:

i. a threaded nut imbedded in the center of said upper convex surface of said flight body;

ii. said shaft being threaded at said proximal end thereof, thereby permitting a threaded attachment of said shaft to said threaded nut; and, iii. a knurled locking nut threadably attachable to said threaded shaft, whereby said threaded attachment of said shaft to said threaded nut may be made more secure;

e. propeller blade pitch adjustment means, whereby the angle of said propeller blades with respect to the horizontal may be varied from 0° to 90°, said propeller blade pitch adjustment means including set screws, said set screws being threadably embedded in said circular rim of said central wheel portion of said propeller assembly, the longitudinal axis of said set screws being parallel to said shaft;

f. light generating means, said light generating means including:

i. battery retaining means, said battery retaining means comprising a small cavity and a small plug, said plug being threadably engageable with said cavity, said cavity being located in the center of said concave surface of said flight body;

ii. a battery of a size suitable to be retained in said cavity by said plug;

iii. a first plurality of light bulbs mounted in said rim of said flight body so that said bulbs are flush with said outer surface of said rim of said flight body, and a second plurality of light bulbs mounted in said flight body so that said bulbs are flush with said convex surface of said flight body, said first and second plurality of light bulbs being in electrical contact with said battery; and, iv. switch means to turn said first and second pluralities of light bulbs on and off, said switch being located on said concave surface of said flight body.

2. An aerodynamic toy, comprising:

a substantially saucer-shaped flight body having an upper convex surface and a lower concave surface, a circumferential rim contiguous with and extending downwardly from said upper and lower surfaces;

light generating means on said flight body for creating a pleasing visual effect when said toy is used, thereby facilitating use of said toy under conditions of poor visibility;

a shaft extending upwardly from the center of said flight body, said shaft having proximal and distal ends, means removably securing said proximal end of said shaft to said flight body;

a propeller assembly rotatably mounted on said shaft adjacent said distal end of said shaft;

said propeller assembly including a hub mounted on said shaft;

a plurality of vanes fixedly secured to said hub and extending radially therefrom;

a circular rim fixedly secured to said vanes, said circular rim including a plurality of horizontal through extending apertures;

a plurality of propeller blades, each of said propeller blades terminating in a short cylindrical neck, each of said necks received in one of said horizontal apertures; and propeller pitch adjustment means adjustably securing said necks in said horizontal apertures, whereby the angle of said propeller blades with respect to the horizontal may be varied between 0 and 90 degrees.

3. The aerodynamic toy of claim 2, wherein said means removably securing said shaft to said flight body comprises:

a threaded nut imbedded in the center of said upper convex surface of said flight body;

said shaft being threaded at said proximal end thereof, thereby permitting a threaded attachment of said shaft to said threaded nut; and a knurled locking nut threadably attachable to said threaded shaft, whereby said threaded attachment of said shaft to said threaded nut may be made more secure.

4. The aerodynamic toy of claim 2, wherein said propeller pitch adjustment means comprises:

a plurality of indentations set about a circumference of each of said necks of said propeller blades;

a plurality of vertical threaded apertures in said circular rim of said propeller assembly, said threaded apertures terminating at said horizontal apertures in said circular rim; and a plurality of set screws threadable into said vertical apertures and engageable with said indentations in said necks of said propeller blades.

5. The aerodynamic toy of claim 2, wherein said light generating means comprises:

battery retaining means, said battery retaining means including a small cavity and a small plug, said plug being threadably engaged with said cavity, said cavity being located in the center of said concave surface of said flight body;

a battery of a size suitable to be retained in said cavity by said plug;

light bulb retaining means, including at least one through extending aperture in said flight body, said bulb retaining means further including a removable plug threadably engageable with said through extending aperture, said removable plug being located on said inner surface of said flight body; and switch means to turn said at least one light bulb on and off, said switch means being located on said concave surface of said flight body.

6. An aerodynamic toy, comprising:

a substantially saucer-shaped flight body having an upper convex surface and a lower concave surface, a circumferential rim contiguous with and extending downwardly from said upper and lower surfaces;

a shaft extending upwardly from the center of said flight body, said shaft having proximal and distal ends, means removably securing said proximal end of said shaft to said flight body;

a propeller assembly mounted on said shaft adjacent said distal end of said shaft;

said propeller assembly including a hub mounted on said shaft;

a plurality of vanes fixedly secured to said hub and extending radially therefrom;

a circular rim fixedly secured to said vanes; and a plurality of propeller blades attached to said circular rim.

7. The aerodynamic toy of claim 6, wherein said means removably securing said shaft to said flight body comprises:

a threaded nut imbedded in the center of said upper convex surface of said flight body;

said shaft being threaded at said proximal end thereof, thereby permitting a threaded attachment of said shaft to said threaded nut; and a knurled locking nut threadably attachable to said threaded shaft, whereby said threaded attachment of said shaft to said threaded nut may be made more secure.

8. The aerodynamic toy of claim 6, further comprising propeller pitch adjustment means adjustably securing said propeller blades to said circular rim, whereby the angle of said propeller blades with respect to the horizontal may be varied between 0 and 90 degrees.

9. The aerodynamic toy of claim 8, wherein said propeller pitch adjustment means comprises:

a plurality of horizontal through extending apertures spaced around said circular rim;

each of said propeller blades terminating in a short cylindrical neck, each of said necks received in one of said horizontal apertures;

a plurality of indentations set about a circumference of each of said necks of said propeller blades;

a plurality of vertical threaded apertures in said circular rim of said propeller assembly, said threaded apertures terminating at said horizontal apertures in said circular rim; and a plurality of set screws threadable into said vertical apertures and engageable with said indentations in said necks of said propeller blades.

10. The aerodynamic toy of claim 6, further comprising light generating means on said flight body for creating a pleasing visual effect when said toy is used, thereby facilitating use of said toy under conditions of poor visibility.

11. The aerodynamic toy of claim 10, wherein said light generating means comprise:

battery retaining means, said battery retaining means including a small cavity and a small plug, said plug being threadably engaged with said cavity, said cavity being located in the center of said concave surface of said flight body;

a battery of a size suitable to be retained in said cavity by said plug;

light bulb retaining means, including at least one through extending aperture in said flight body, said bulb retaining means further including a removable plug threadably engageable with said through extending aperture, said removable plug being located on said inner surface of said flight body; and switch means to turn said at least one light bulb on and off, said switch means being located on said concave surface of said flight body.

* * * * *